US005207427A

United States Patent [19]

Saeki

[11] Patent Number: 5,207,427

[45] Date of Patent: May 4, 1993

[54] GOLF CLUB HEAD AND MANUFACTURING METHOD THEREOF

[75] Inventor: Minoru Saeki, Higashi7osaka, Japan

[73] Assignee: Sumitomo Rubber Industries, Ltd., Kobe, Japan

[21] Appl. No.: 872,812

[22] Filed: Apr. 24, 1992

[30] Foreign Application Priority Data

May 9, 1991 [JP] Japan ..... 3-135491

[51] Int. Cl.[5] ..... A63B 53/04

[52] U.S. Cl. ..... 273/167 R; 273/167 J; 205/67

[58] Field of Search ..... 273/167-175, 273/77 R, DIG. 23; 205/67

[56] References Cited

U.S. PATENT DOCUMENTS

| | | | |
|---|---|---|---|
| 3,427,231 | 2/1969 | Schneider et al. | 205/67 |
| 3,437,568 | 4/1969 | Hasselman et al. | 205/67 |
| 3,498,890 | 3/1970 | Divecha et al. | 205/67 |
| 4,964,641 | 10/1990 | Miesch et al. | 273/173 X |
| 5,062,638 | 11/1991 | Shira | 273/167 R |
| 5,104,457 | 4/1992 | Viljoen et al. | 273/167 R X |
| 5,131,986 | 7/1992 | Harada et al. | 273/167 HX |

FOREIGN PATENT DOCUMENTS

| | | | |
|---|---|---|---|
| 0026929 | 2/1977 | Japan | 273/167 J |
| 0083677 | 5/1985 | Japan | 273/167 J |
| 1-73353 | 6/1989 | Japan . | |
| 1-259878 | 10/1989 | Japan | 273/167 R |
| 2-080070 | 3/1990 | Japan | 273/167 R |
| 2-149279 | 6/1990 | Japan | 273/167 R |
| 2-168974 | 6/1990 | Japan | 273/167 R |

*Primary Examiner*—Vincent Millin
*Assistant Examiner*—Sebastiano Passaniti
*Attorney, Agent, or Firm*—Armstrong, Westerman, Hattori, McLeland & Naughton

[57] ABSTRACT

A partially or entirely exposed metal portion of a club head body is formed with a foundation layer on the surface thereof by means of electroplating, and the foundation layer is covered with a non-electrolytic nickel-boron plating. Moreover, this non-electrolytic nickel-boron plating has a chromate film applied to the surface thereof by using a chromate treatment. The foregoing foundation layer comprises a first electrolytic nickel plating for preventing rust of the head body and a second electrolytic nickel plating for improving the close contact of the non-electrolytic nickel-boron plating with the foundation layer.

9 Claims, 2 Drawing Sheets

GOLF CLUB HEAD AND MANUFACTURING METHOD THEREOF

BACKGROUND AND SUMMARY OF THE INVENTION

This invention relates to a golf club head and a manufacturing method thereof, and in particular to a surface treatment thereof.

In general, golf club heads and particularly iron heads are electroplated directly with chromium, or are electroplated firstly with nickel and then with chromium. For this reason, the club heads are silvery in their surface color.

However, in recent years, the silver color of the club heads does not occasionally satisfy the chromatic needs of the golf club purchasers or users who regard the color of purchasing articles as important from the viewpoint of the motivation of purchase or use. Therefore, as shown and described in, for example, Japanese Utility Model Application No. 1-73353 filed on Jun. 21, 1989, a golf club head of golden surface color was developed. However, this golden color is obtained by using electrolytic nickel-boron plating.

However, the golf club heads of non-electrolytic nickel-boron boron plating are oxidized and discolored on their surfaces if they remain exposed to the atmosphere. This is a disadvantage of the golf club heads which have non-electrolytic nickel-boron plating applied to them.

Usually, the conventional golf club heads are die-stamped with marks for improvement in their design value or for the identification of the club types. In this case, the plating has difficulty in adhering around such die-stamped marks or to their edge portions and to the edge portions of the face lines, and both of these edge portions tend to corrode easily.

It is therefore an object of the present invention to provide for a golf club head and a manufacturing method thereof in which the surface thereof is plated so as to have a color other than silver, for example, gold in particular, and remains undiscolored even after exposure to the atmosphere and also in which the peripheral edge portions of the die-stamped marks are superior in their resistance to corrosion.

BRIEF DESCRIPTION OF THE DRAWINGS

The present invention will be described with reference to the accompanying drawings, in which.

DESCRIPTION OF THE PREFERRED EMBODIMENTS OF THE PRESENT INVENTION

Figure 1:
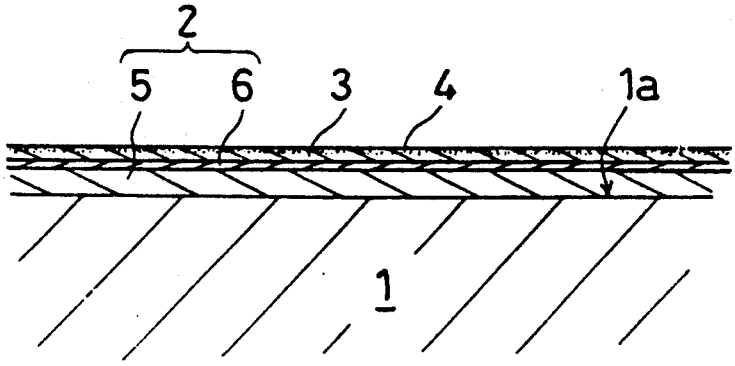
FIG. 1 is an enlarged sectional view of a principal portion of a golf club head manufactured according to a preferred embodiment of the present invention.
Figure 2:
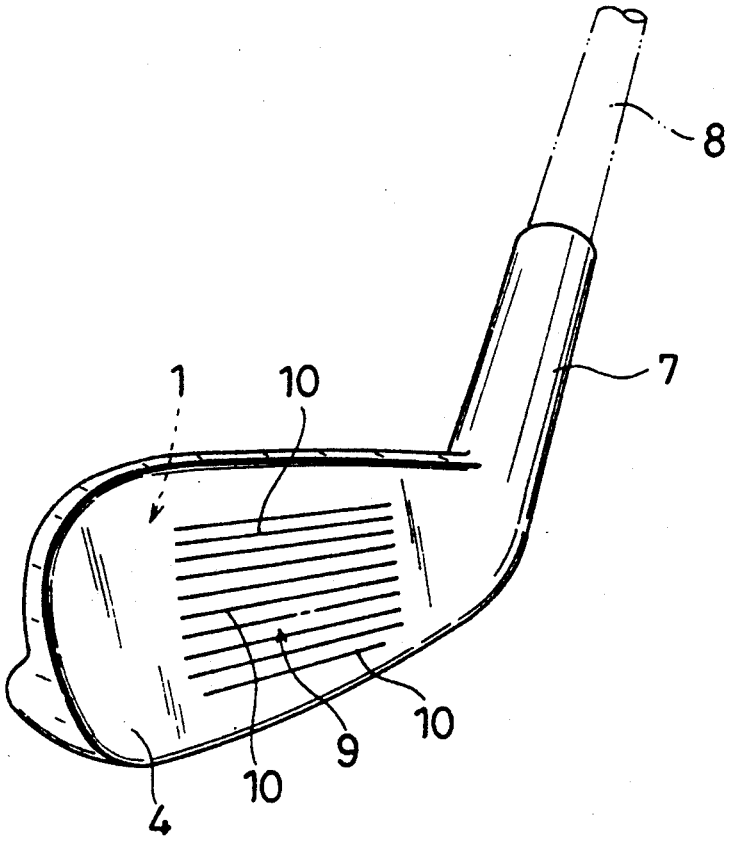
FIG. 2 is a perspective view of the entire golf club head shown in FIG. 1.

A club head shown in FIG. 2 as a preferred embodiment an present invention is of the iron type of golf club. This head is provided with a neck 7 which has a shaft 8 connected thereto. The head also includes a face 9 which is generally formed with face lines 10. As shown in FIG. 1, this head comprises a metallic head body 1, a foundation layer 2, a non-electrolytic nickel-boron plating 3, and a chromate-treated coating 4 formed on the surface of the plating 3.

The foundation layer 2 covers a surface 1*a* of the head body 1, and comprises two layers, a first electrolytic nickel plating 5 and a second electrolytic nickel plating 6.

A process for manufacturing the golf club head of the foregoing construction according to the present invention will now be described.

The head body 1 made of steel or iron is formed with the first electrolytic nickel plating 5 on the surface 1*a* thereof, and this nickel plating 5 is ground. Subsequently, this nickel plating 5 has the second electrolytic nickel plating 6 formed thereon. As a result, the foundation layer 2 is produced by means of the first and second electrolytic nickel plating 5 and 6, and covers the surface 1*a* of the head body 1.

The first electrolytic nickel plating 5 functions to prevent corrosion of the head body 1, and the second electrolytic nickel plating 6 serves for improvement in the close contact of the non-electrolytic nickel-boron plating 3 with the foundation layer 2.

Figure 3:
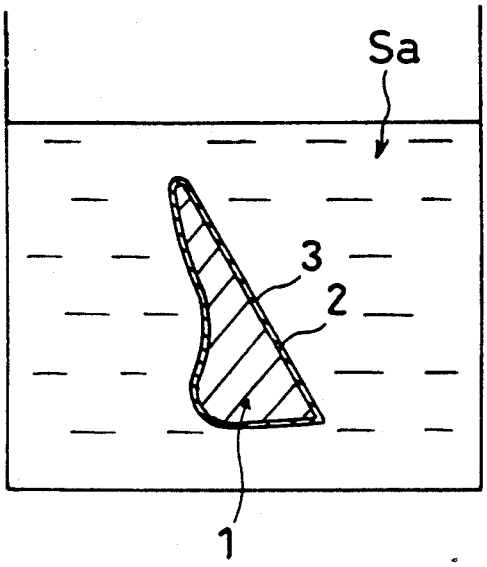
FIG. 3 is a sectional view of a container filled with a nickel-boron solution in which a material club head body is immersed to form a non-electrolytic nickel-boron plating on the surface of the material club head body as the primary step in the surface treatment of the material club head according to a preferred embodiment of the present invention.

Next, the head body 1 formed with the foundation layer 2 which comprises the first and second electrolytic nickel platings 5 and 6 is immersed in a nickel-boron solution Sa as shown in FIG. 3 to form the non-electrolytic nickel-boron plating 3 on the foundation layer 2.

Figure 4:
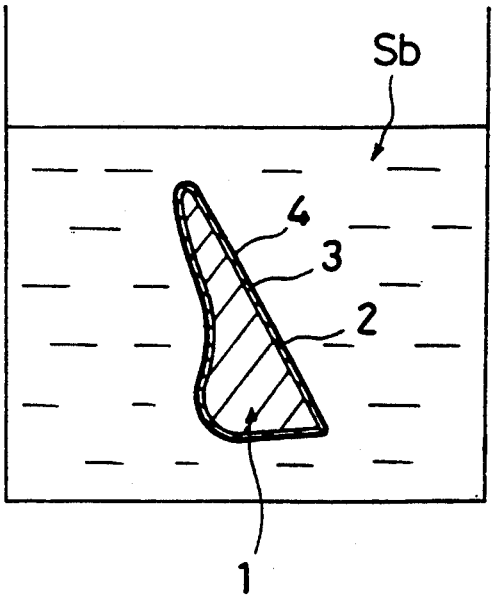
FIG. 4 is a sectional view of a container filled with a chromate solution in which the material club head body formed with the non-electrolytic nickel-boron plating on the surface thereof as shown in FIG. 3 is immersed to form a chromate film on the surface of the non-electrolytic nickel-boron plating applied to the material club head body as shown in FIG. 3 as the secondary step in the surface treatment of the material club head according to the preferred embodiment of the present invention.

Thereafter, the head body 1 thus formed with the non-electrolytic nickel-boron plating 3 on the uppermost layer thereof has a chromate treatment applied thereto, thereby allowing a chromate film 4 to be formed on the surface of the non-electrolytic nickel-boron plating 3. In practice, the head body 1 is immersed in a chromate solution Sb of a predetermined temperature under a specified voltage for the required time as shown in FIG. 4, and as a result, the formation of the chromate film 4 is achieved on the surface of the non-electrolytic nickel-boron plating.

The chromate solution Sb contains the following ingredients: chromic acid anhydride (4 g to 10 g/lit.), sulfuric acid (0.5 g to 5 g/lit.), nitric acid (1 g to 5 g/lit.) and the like. Also, in the execution of the chromate treatment, the chromate solution Sb is desired to be 2.5 to 3.5 in the pH thereof, and 19° C. to 25° C. in the temperature thereof. Moreover, preferably, an electric voltage applied to the chromate solution is 3 V to 5 V, and the treating time is 30 seconds or more.

Eight kinds of club heads were subjected to neutral-salt spray testing and outdoor exposure testing. The applied conditions, results and other particulars of these tests will now be described.

The voltage and time respectively used in chromate treatments applied to the eight club heads of the testing samples a, b, c, d, e, f, g and h are as listed in Table 1.

As is apparent from Table 1, in the chromate treatment of the "a" club head, the applied voltage is 2 V, and the time for which it is immersed in the chromate solution is 60 seconds. In that of the "b" club head, the applied voltage is 3 V, and the time for which it is immersed in the chromate solution is 60 seconds. In that of the "c" club head, the applied voltage is 4 V, and the time for which it is immersed in the chromate solution is 60 seconds.

TABLE 1

| | Time (sec.) | | | |
|---|---|---|---|---|
| Voltage (V) | 0 | 30 | 60 | 90 |
| 2 | | | a | |
| 3 | | | b | |
| 4 | | | c | |
| 5 | d | e | f | g |
| 7 | | | h | |

As far as the "d" club head is concerned, the applied voltage is 5 V, while the time for which it is immersed in the chromate solution is 0 second, and this means that the "d" club head is not subjected to the chromate treatment. In the chromate treatment of the "e" club head, a voltage of 5 V is used, and it is immersed in the chromate solution for 30 seconds. In the chromate treatment of the "f" club head, the applied voltage is 5 V, and the time for which it is immersed in the chromate solution is 60 seconds. In that of the "g" club head, the applied voltage is 5 V, and the time for which it is immersed in the chromate solution is 90 seconds. Under a voltage of 7 V, the "h" club head is immersed in the chromate treatment for 60 seconds.

The chromate solution Sb remains constant in the chemical composition thereof, and has a pH of 3 and a temperature of 22° C.±3° C.

The results of the neutral-salt spray testing and the outdoor testing carried out upon the foregoing eight kinds of club heads are as shown in Table 2.

TABLE 2

| | | Test | |
|---|---|---|---|
| Club Head | | Neutral-Salt Spray Testing | Outdoor Exposure Testing (for a week) |
| Chromate-Treated Club Heads (Testing Specimens) | a | A | C |
| | b | A | B |
| | c | A | A |
| | e | A | A |
| | f | A | A |
| | g | A | A |
| | h | A | A |
| Club Head Non-treated with Chromate | d | H (Much red rust found at the die-stamped portions) | C (Much red rust found at the die-stamped portions) |

In Table 2, the letter A represents that the club head is free from any discoloration, the letter B represents that the club head becomes whitish without any stain, the letter C represents that the club head undergoes light white stain, and the letter E represents that the club head undergoes red stain.

The neutral-salt spray testing was to check the testing specimen, namely, the club head for corrosion while it is sprayed with a solution of neutral salt of constant conditions, and this test was performed substantially as specified in the standards JIS Z 2371-1967. The testing conditions are as shown in Table 3.

In practice, eleven club heads for each of the eight kinds of club heads a to h were subjected to the neutral-salt spray testing in which their backward surfaces were sprayed with neutral salt for 24 hours under the testing conditions specified in Table 3.

TABLE 3

| | |
|---|---|
| Concentration of sodium chloride solution (W/V %) | 4.0~6.0 |
| pH | 6.5~7.2 |
| Pressure of Compressed Air (kg/cm) | 0.7~1.8 |
| Saturation Temperature of Air (°C.) | 47 ± 1 |
| Temperature of Neutral-Salt Tank (°C.) | 35 ± 1 |
| Temperature of Testing Room (°C.) | 35 ± 1 |

Also, in the outdoor exposure testing, the eight kinds of club heads a to h were left outdoors for a week.

As a result of the neutral-salt spray testing and the outdoor exposure testing, it is understood from Table 2 that club heads of good quality in their surface plating are obtained from a chromate treatment in which the chromate solution Sb is 22° C.±3° C. in the temperature thereof, the treating voltage is 3 V to 5 V, and the treating time is 30 seconds or above. If a club head is not subjected to any chromate treatment, this club head will be damaged on the surface plating. This is apparent from the tested club head d which was not treated with chromate. That is to say, this club head d created in the neutral-salt spray testing thereof red stains, and moreover, much red rust at the die-stamped portions thereof for improvement in the design value thereof and for the identification of a club type. Also, in the outdoor exposure testing, the club head d produced light whitish stains, and much red rust at the die-stamped portions.

A voltage of 7 V was applied in the chromate treatment of the club head h. This voltage does not cause any trouble as to the discoloration resistance and corrosion resistance of the club head, as shown in Table 2. However, the voltage value of 7 V is comparatively high, and therefore, occasionally causes a gold color of the edge of the club head to be deepened in the tone thereof. Because of this, it is not recommended to apply a voltage of 7 V for the chromate treatment of the club head.

In the foregoing preferred embodiment of the present invention, a non-electrolytic nickel-boron plating 3 and the chromate film 4 are both formed on the entire surface of the head body 2. However, as a matter of course, they may be only applied to a part of the club head, for example, the sole portion thereof.

Moreover, the foregoing surface treatment including the non-electrolytic nickel-boron plating and the formation of the chromate film may be preferably applied to a wood type hollow metallic club head which is generally called the metal wood head.

Also, preferably, the first electrolytic nickel-plating 5 is 18 microns to 24 microns in the thickness thereof, the second electrolytic nickel plating 6 is 0.3 microns to 0.5 microns in the thickness thereof, and the non-electrolytic nickel-boron plating 3 is 2.0 microns to 2.5 microns in the thickness thereof. However, the thickness of these platings can be freely varied.

The golf club head according to the present invention is coated with the non-electrolytic nickel-boron plating 3 of a golden color on the entire or partial metal surface of the foundation layer 2 thereof. This golf club head therefore meets the chromatic needs of the golf club purchasers or users. Moreover, the plating 3 is formed with the chromate film 4 on the surface thereof. Therefore, this plating 3 is unexposed directly to the atmosphere, does not fade in the golden color thereof as a whole, and is superior in the corrosion resistivity thereof as well as the durability thereof.

The present invention may be practiced otherwise without departing from the spirit and indispensable characteristics thereof. For example, if the head body 1 has a metal outside exposed only at a portion thereof, this exposed metal is coated with the non-electrolytic nickel-boron plating 3 and the chromate film 4 as described. It will be readily understood that this is included in the scope of the present invention, and therefore that the foregoing preferred embodiment is only illustrative and not restrictive.

I claim:

1. A golf club head comprising: a head body coated with an electrolytic foundation layer on a partial or entire outer surface thereof, the foundation layer being covered with a non-electrolytic nickel-boron plating, said non-electrolytic nickel-boron plating being covered with a chromate film.

2. A golf club head as set forth in claim 1, wherein the head body is a metal body.

3. A golf club head as set forth in claim 1, wherein the head body is a wood body.

4. A golf club head as set forth in claim 1, wherein the foundation layer comprises a first electrolytic nickel plating and a second electrolytic nickel plating covering said first electrolytic plating.

5. A golf club head as set forth in claim 4, wherein the first electrolytic nickel plating ranges between 18 microns and 24 microns in thickness, the second electrolytic plating ranges between 0.3 microns and 0.5 microns in thickness, and the non-electrolytic nickel plating ranges between 2.0 microns and 2.5 microns in thickness.

6. A method for manufacturing a golf club head, comprising the steps of: forming an electrolytic foundation layer on an outer surface of a head body by using electroplating, immersing the head body in a nickel-boron solution to form a non-electrolytic nickel-boron plating over the foundation layer, and subjecting said head body to a chromate treatment to allow a chromate film to be formed over the non-electrolytic nickel-boron plating.

7. A method for manufacturing a golf club head as set forth in claim 6, wherein the step of forming an electrolytic foundation layer on the outer surface of the head body comprises the steps of: forming a first electrolytic nickel plating on the outer surface of the head body, grinding the first electrolytic nickel plating, and then forming a second electrolytic nickel plating on the first electrolytic nickel plating whereby the foundation layer is formed on the head body by the first and second platings.

8. A method for manufacturing a golf club head as set forth in claim 6, wherein a chromate solution of 2.5 to 3.5 in pH and 19° C. to 25° C. in temperature is used for said chromate treatment.

9. A method for manufacturing a golf club head as set forth in claim 6 or 8, wherein the chromate treatment is executed under a voltage of 3 V to 5 V for 30 seconds to 90 seconds.

* * * * *